US007572173B2

(12) United States Patent
Huang et al.

(10) Patent No.: US 7,572,173 B2
(45) Date of Patent: Aug. 11, 2009

(54) POLISHING APPARATUS AND PAD REPLACING METHOD THEREOF

(75) Inventors: Shiuh-Jer Huang, Taipei (TW); Guang-Ling He, Taichung (TW); Shu-Yi Lin, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 11/892,047

(22) Filed: Aug. 20, 2007

(65) Prior Publication Data

US 2008/0125022 A1 May 29, 2008

(30) Foreign Application Priority Data

Nov. 24, 2006 (TW) ..... 95143647 A

(51) Int. Cl.
*B24B 29/00* (2006.01)

(52) U.S. Cl. ..... 451/285; 451/287; 451/490; 451/508; 483/32; 483/33

(58) Field of Classification Search ..... 451/340, 451/363, 285, 287, 290, 490, 508; 483/32, 483/33

See application file for complete search history.

(56) References Cited

U.S. PATENT DOCUMENTS 5,584,750 A * 12/1996 Ishida et al. ..... 451/288
5,647,792 A * 7/1997 Katsuoka et al. ..... 451/285
5,704,827 A * 1/1998 Nishi et al. ..... 451/285
5,931,724 A * 8/1999 Perlov et al. ..... 451/285
6,033,293 A * 3/2000 Crevasse et al. ..... 451/494
6,244,941 B1 * 6/2001 Bowman et al. ..... 451/287
6,517,421 B2 2/2003 Park
6,520,841 B2 * 2/2003 Birang et al. ..... 451/41
6,932,678 B2 * 8/2005 Toyoshima et al. ..... 451/42
7,001,251 B2 * 2/2006 Doan et al. ..... 451/41
7,156,722 B2 * 1/2007 Min et al. ..... 451/41
7,377,018 B2 * 5/2008 Taylor ..... 29/402.01
7,448,942 B2 * 11/2008 Miyazawa ..... 451/41
2001/0041650 A1 * 11/2001 Senga et al. ..... 483/1
2004/0072502 A1 * 4/2004 Taylor ..... 451/28
2006/0178096 A1 * 8/2006 Taylor ..... 451/303
2007/0202778 A1 * 8/2007 Toyoshima et al. ..... 451/42

FOREIGN PATENT DOCUMENTS

TW 422761 B 2/2001
TW 536752 B 6/2003

* cited by examiner

*Primary Examiner*—Eileen P. Morgan
(74) *Attorney, Agent, or Firm*—Bacon & Thomas, PLLC

(57) ABSTRACT

A polishing apparatus and a pad replacing method thereof are provided. The polishing apparatus includes a first clamping element, a second clamping element and a polishing head. The first clamping element includes a first upper clamper and a first lower clamper for clamping a first area of a first polishing pad. The second clamping element includes a second upper clamper and a second lower clamper for clamping a second area of the first polishing pad, the first area and the second area are opposite to each other. When the first polishing pad will be disconnected from the bottom surface of the polishing head and replaced by a second polishing pad, the first clamping element and the second clamping element are released from the first polishing pad.

11 Claims, 18 Drawing Sheets

POLISHING APPARATUS AND PAD REPLACING METHOD THEREOF

This application claims the benefit of Taiwan application Serial No. 095143647, filed Nov. 24, 2006, the subject matter of which is incorporated herein by reference.

BACKGROUND OF THE INVENTION

1. Field of the Invention

The invention relates in general to a polishing apparatus and a pad replacing method thereof, and more particularly to a polishing apparatus capable of automatically replacing a polishing pad and a pad replacing method thereof.

2. Description of the Related Art

As semiconductor technology develops, layout with higher density develops continuously. In the semiconductor manufacturing process, layout with higher density requires better surface flatness of the chip for increasing the accuracy of the lithography process. Therefore, chemical mechanical polishing (CMP) has become an important technology in the semiconductor manufacturing process.

FIG. 1 illustrates a conventional polishing apparatus. Please referring to FIG. 1, the polishing apparatus 900 is an inverted-type chemical mechanical polishing apparatus 900. The polishing apparatus 900 includes a polishing head 930, a carrier 960 and a slurry injector 970. A wafer 800 is placed on the carrier 960. The polishing head 930 is disposed over the wafer 800. A polishing pad 700 is adhered to a polishing surface 930*a* of the polishing head 930 by an adhesive. The material of the polishing pad 700 is polyurethane for example. In the polishing process, the polishing head 930 and the wafer 800 rotate along opposite directions. The polishing head 930 applies a proper force F to the wafer 800, and the slurry injector 970 injects slurry 971 between the wafer 800 and the polishing pad 700, for removing surface roughness of the wafer 800. As a result, the required flatness can be achieved.

In the semiconductor manufacturing apparatus, the yield rate (wafer number/working time) is an important factor in evaluating the apparatus. The polishing speed, wafer placing speed or pad replacing time can affect the yield rate of the apparatus.

After the polishing apparatus 900 operates for a while, the polishing pad 700 is worn out gradually. The polishing apparatus 900 needs a new polishing pad 700 for continuing the polishing process. The polishing pad 700 is adhered to the polishing head 930 by the adhesive. Therefore, when the polishing pad 700 is replaced, a tool, such as a rasp, is needed to completely remove the polishing pad 700. Then, a new polishing pad 700 is adhered. It takes a long time to replace the polishing pad. Therefore, the polishing apparatus 900 also stops working for a long time. As a result, the yield rate of the polishing apparatus 900 is decreased significantly, and the polishing head 930 might be damaged.

Furthermore, the hardness and holes of each polishing pad 700 are corresponding to the manufacturing conditions and the object (such as metal conductor or dielectric) needed to be removed from the surface of the wafer 800. When the manufacturing conditions or the object needed to be removed is different, different polishing pad 700 is used. However, when the polishing pad 700 is replaced, the old polishing pad 700 is damaged and can no longer be used, which is very wasteful. Therefore, the manufacturing conditions and the object needed to be removed can change randomly. As a result, the flexibility of the manufacturing process of the polishing apparatus 900 is lowered.

Therefore, it is very important to develop a polishing apparatus to solve the above problems.

SUMMARY OF THE INVENTION

The invention is directed to a polishing apparatus and a pad replacing method thereof. A first clamping element and a second clamping element are used for clamping a polishing pad. Also, a pad-replacing box is used together so that the polishing apparatus and the pad replacing method thereof are convenient to use and perform. The pad replacing time is reduced. The yield rate of the polishing apparatus is increased. The utilization efficiency of the polishing pad is increased. The polishing head is prevented from damage.

According to the present invention, a polishing apparatus is provided. The polishing apparatus includes a first clamping element, a second clamping element and a polishing head. The first clamping element includes a first upper clamper and a first lower clamper for clamping a first area of a first polishing pad. The second clamping element includes a second upper clamper and a second lower clamper for clamping a second area of the first polishing pad. The first area and the second area are opposite to each other. When the first polishing pad is attached flatly with the bottom surface of the polishing head and polish an article, the first clamping element and the second clamping element clamp the first polishing pad and are fastened on the periphery of the polishing head. When the first polishing pad will be disconnected from the bottom surface of the polishing head and replaced by a second polishing pad, the first clamping element and the second clamping element are released from the polishing head.

According to the present invention, a pad replacing method for replacing a first polishing pad of a polishing apparatus is provided. The polishing apparatus includes a first clamping element, a second clamping element and a polishing head. The first clamping element includes a first upper clamper and a first lower clamper. The second clamping element includes a second upper clamper and a second lower clamper. The first upper clamper and the first lower clamper are for clamping one end of the first polishing pad. The second upper clamper and the second lower clamper are for clamping another end of the first polishing pad. When the first clamping element and the second clamping element clamp the first polishing pad and are connected with the periphery of the polishing head, the first polishing pad flatly contacts a polishing surface of the polishing head. The pad replacing method at least includes following step. In a step (a), the first clamping element and the second clamping element are driven to be unloaded from the polishing head. In a step (b), it is determined if the first clamping element and the second clamping element clamp the first polishing pad. If yes, the method goes to a step (c). If no, the method goes to a step (d). In the step (c), the first polishing pad is driven to slide out from the first clamping element and the second clamping element. In the step (d), a second polishing pad is driven to slide into the first clamping element and the second clamping element.

The invention will become apparent from the following detailed description of the preferred but non-limiting embodiments. The following description is made with reference to the accompanying drawings.

DETAILED DESCRIPTION OF THE INVENTION

Figure 1:
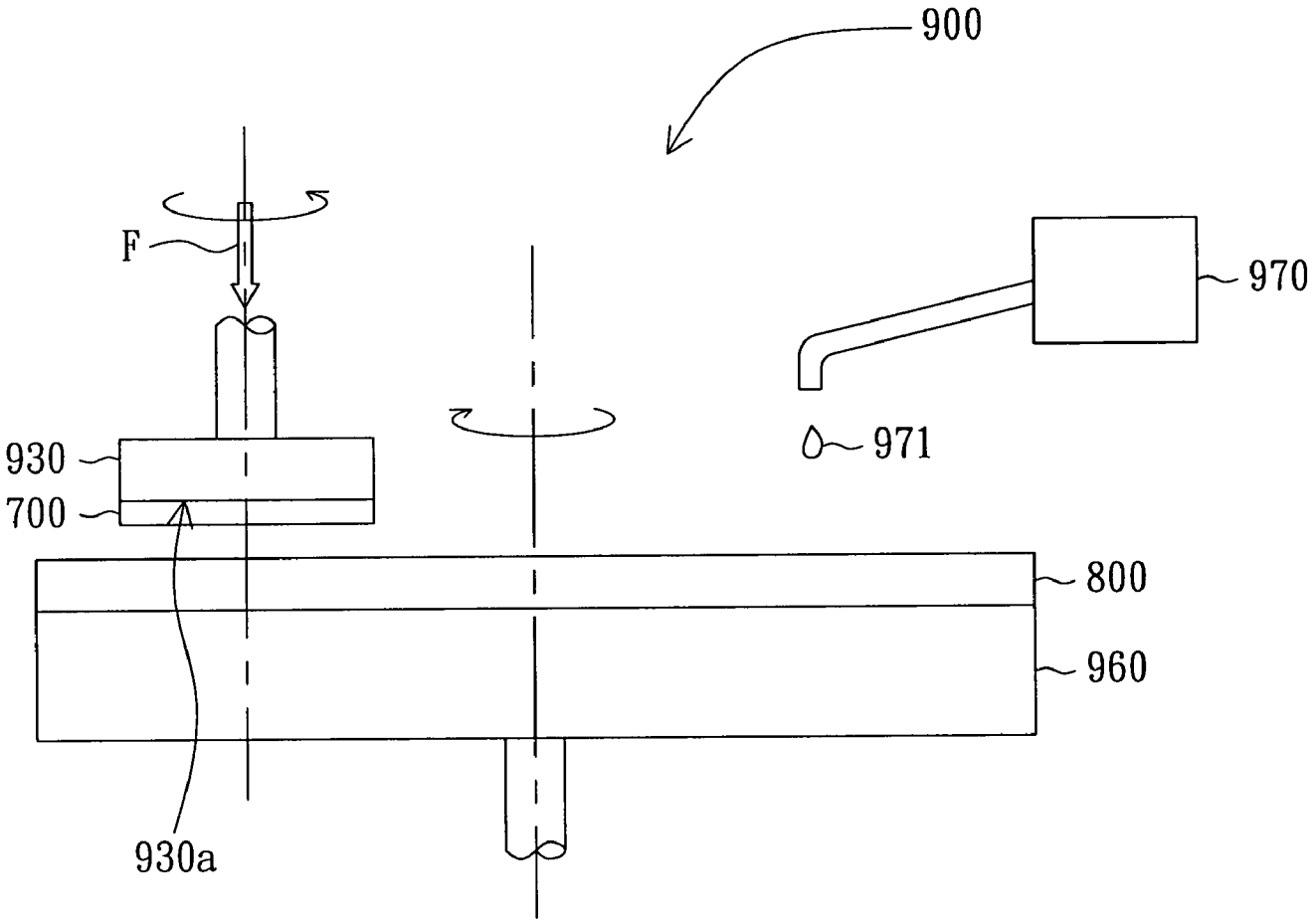
FIG. 1(PRIOR ART)
FIG. 1 (Prior Art) illustrates a conventional polishing apparatus.
Figure 2:
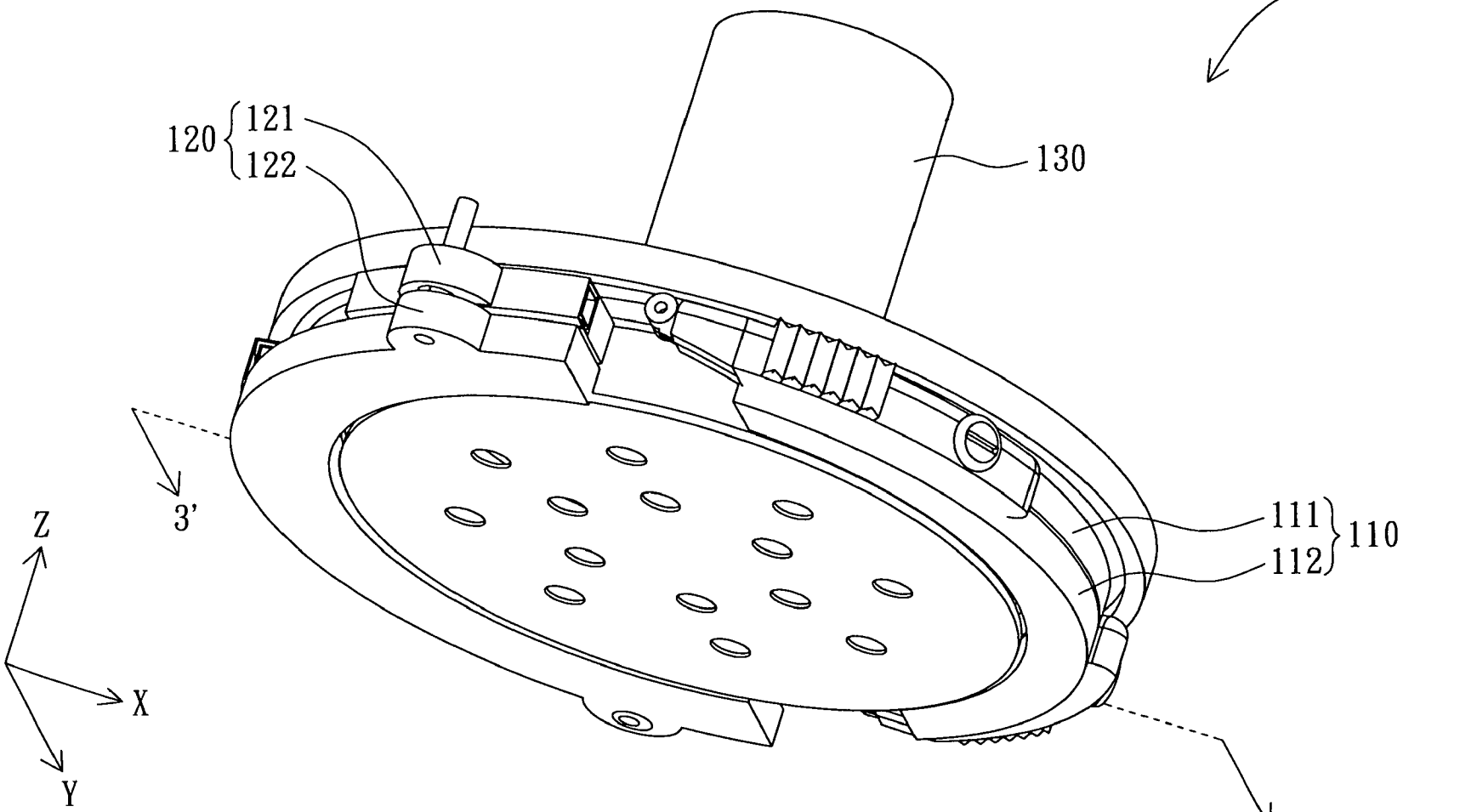
FIG. 2 illustrates a polishing apparatus according to a preferred embodiment of the present invention.

Please refer to FIG. 2. A polishing apparatus 100 according to a preferred embodiment of the present invention is illustrated in FIG. 2. The polishing apparatus 100 includes a first clamping element 110, a second clamping element 120 and a polishing head 130. The first clamping element 110 includes a first upper clamper 111 and a first lower clamper 112. The first upper clamper 111 and the first lower clamper 112 are for clamping a first area of the first polishing pad 200 (shown in FIG 3A and FIG. 3B). The second clamping element 120 includes a second upper clamper 121 and a second lower clamper 122. The second upper clamper 121 and the second lower clamper 122 are for clamping a second area of the first polishing pad 200. The first area and the second area are opposite to each other.

Figure 3A:
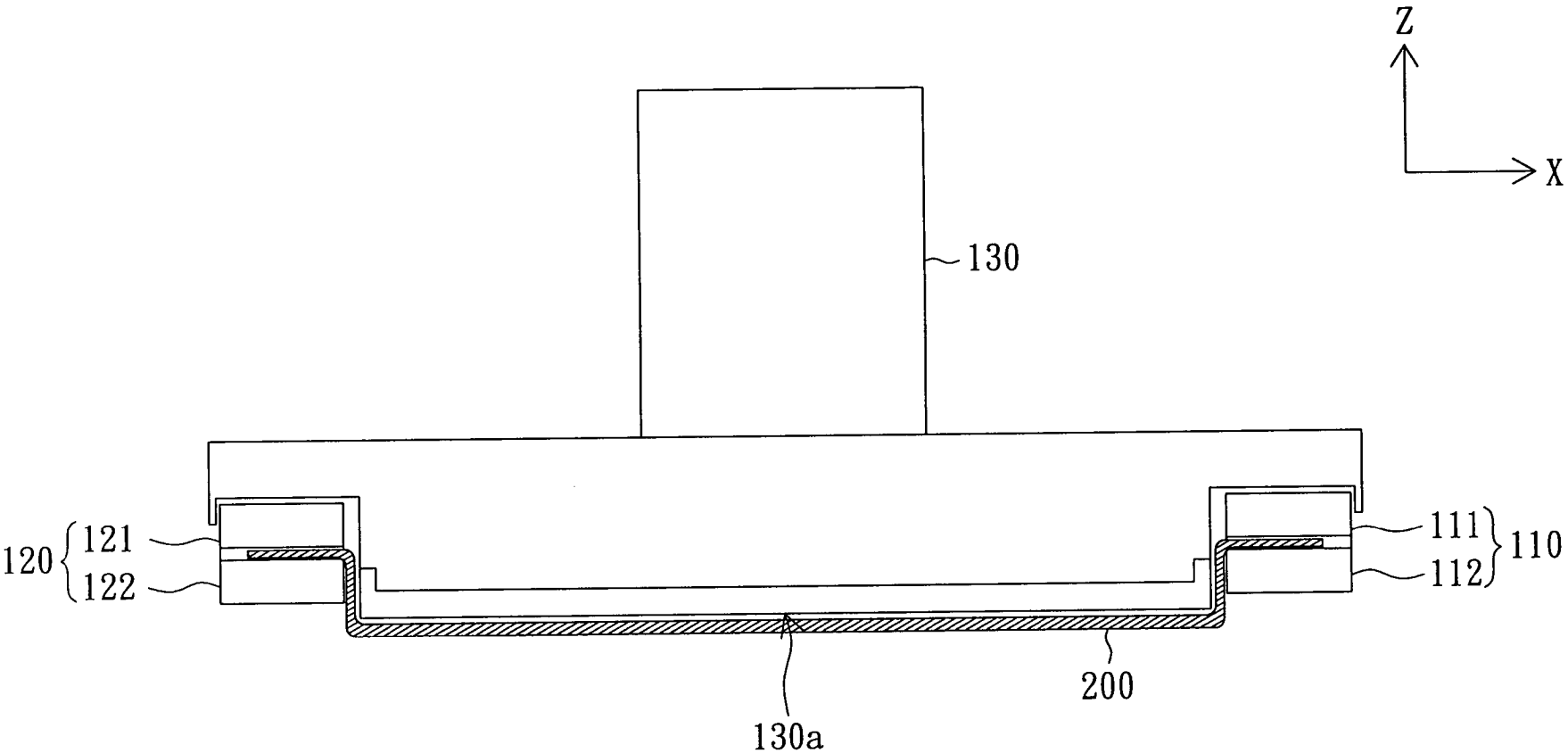
FIGS. 3A~3B are cross-sectional views of the polishing apparatus along a cross-sectional line 3-3' in FIG. 2.
Figure 3B:
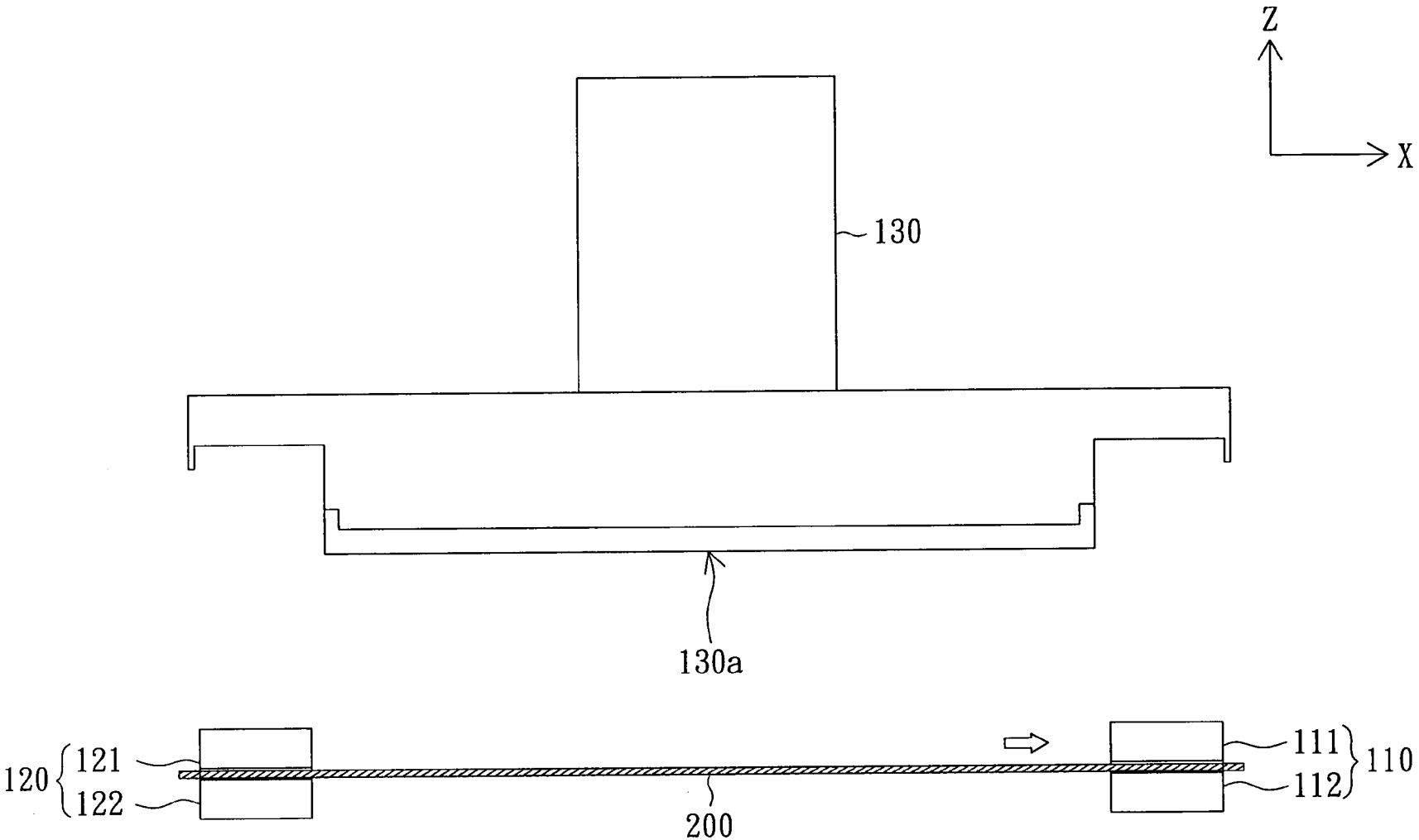

Please refer to FIG. 3A and FIG. 3B. FIGS. 3A~3B are cross-sectional views of the polishing apparatus 100 in FIG. 2 along a cross-sectional line 3-3'. The polishing head 130 has a polishing surface 130. When the first polishing pad 200 is attached flatly with the bottom surface of the polishing head 130 and polish an article, the first clamping element 110 and the second clamping element 120 clamp the first polishing pad 200 and are fastened on the periphery of the polishing head 130. As shown in FIG. 3B, when the first polishing pad will be disconnected from the bottom surface of the polishing head and replaced by a second polishing pad, the first clamping element 110 and the second clamping element 120 are released from the polishing head 130. Then, a second polishing pad 300 (shown in FIG. 6H) slides into the first clamping element 110 and the second clamping element 120.

Figure 4:
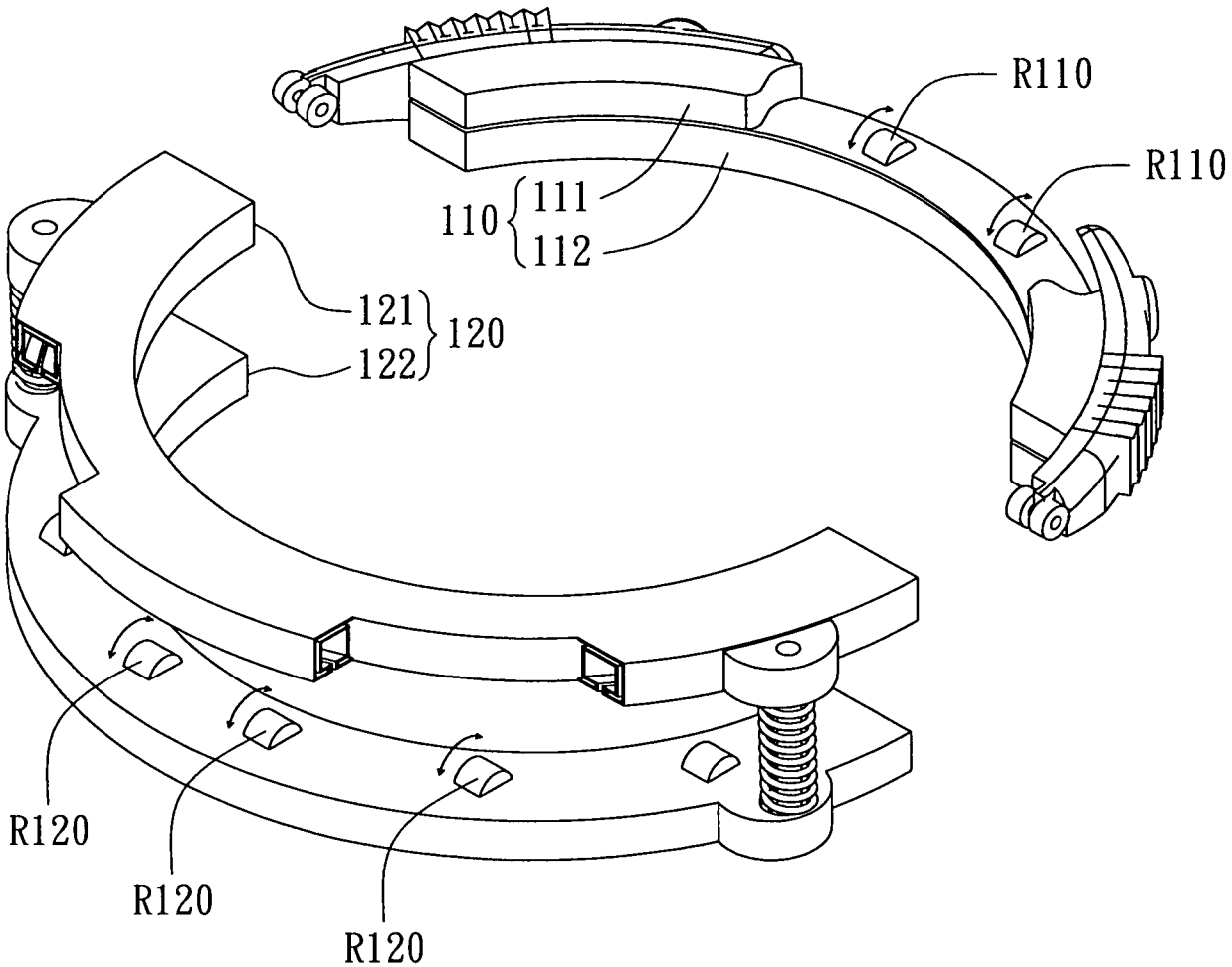
FIG. 4 is an exploded view of a first clamping element and a second clamping element in FIG. 2.

Please refer to FIG. 4. FIG. 4 is an exploded view of the first clamping element 110 and the second clamping element 120 in FIG. 2. The first clamping element 110 further includes several first rollers R110 disposed between the first upper clamper 111 and the first lower clamper 112. When the first rollers R110 roll, the first polishing pad 200 slides out from the first upper clamper 111 and the first lower clamper 112 through the first rollers R110. Similarly, when the first rollers R110 roll, the second polishing pad 300 slides into the first clamping element 110 and between the first upper clamper 111 and the first lower clamper 112 (the first polishing pad 200 illustrated in FIGS. 3A~3B, the second polishing pad 300 illustrated in FIG. 6H).

The second clamping element 120 further includes several second rollers R120 disposed between the second upper clamper 121 and the second lower clamper 122. The first polishing pad 200 and the second polishing pad 300 slide smoothly between the second upper clamper 121 and the second lower clamper through the second rollers R120. Preferably, the first rollers R110 and the second rollers R120 are parallel to the same direction, so the first polishing pad 200 and the second polishing pad 300 can slide smoothly.

Please referring to an accompanying flow chart and drawings, a pad replacing method of the polishing apparatus 100 of the present invention is illustrated as follow.

Figure 5:
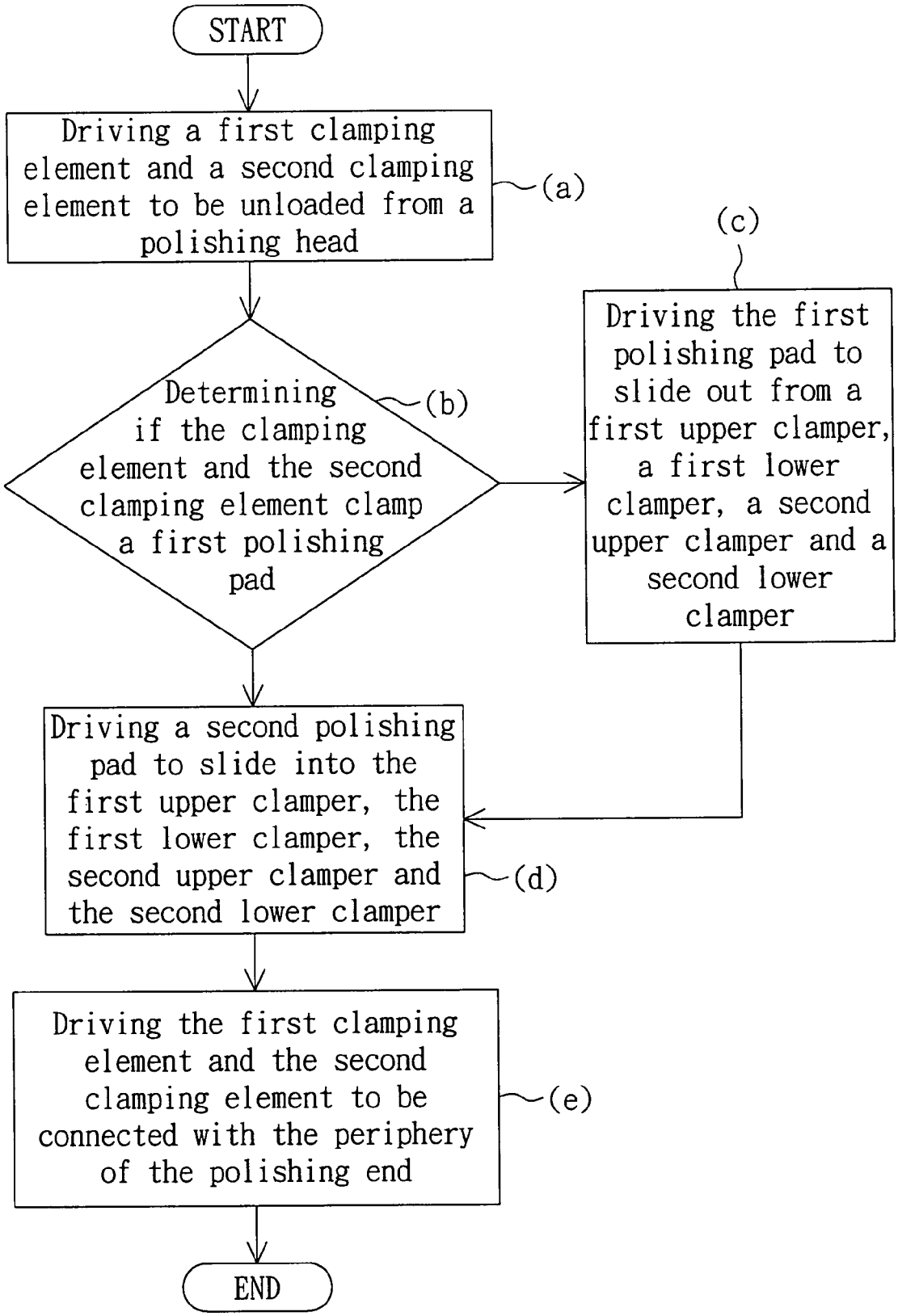
FIG. 5 is a flow chart of a pad replacing method according to the preferred embodiment of the present invention.
Figure 6A:
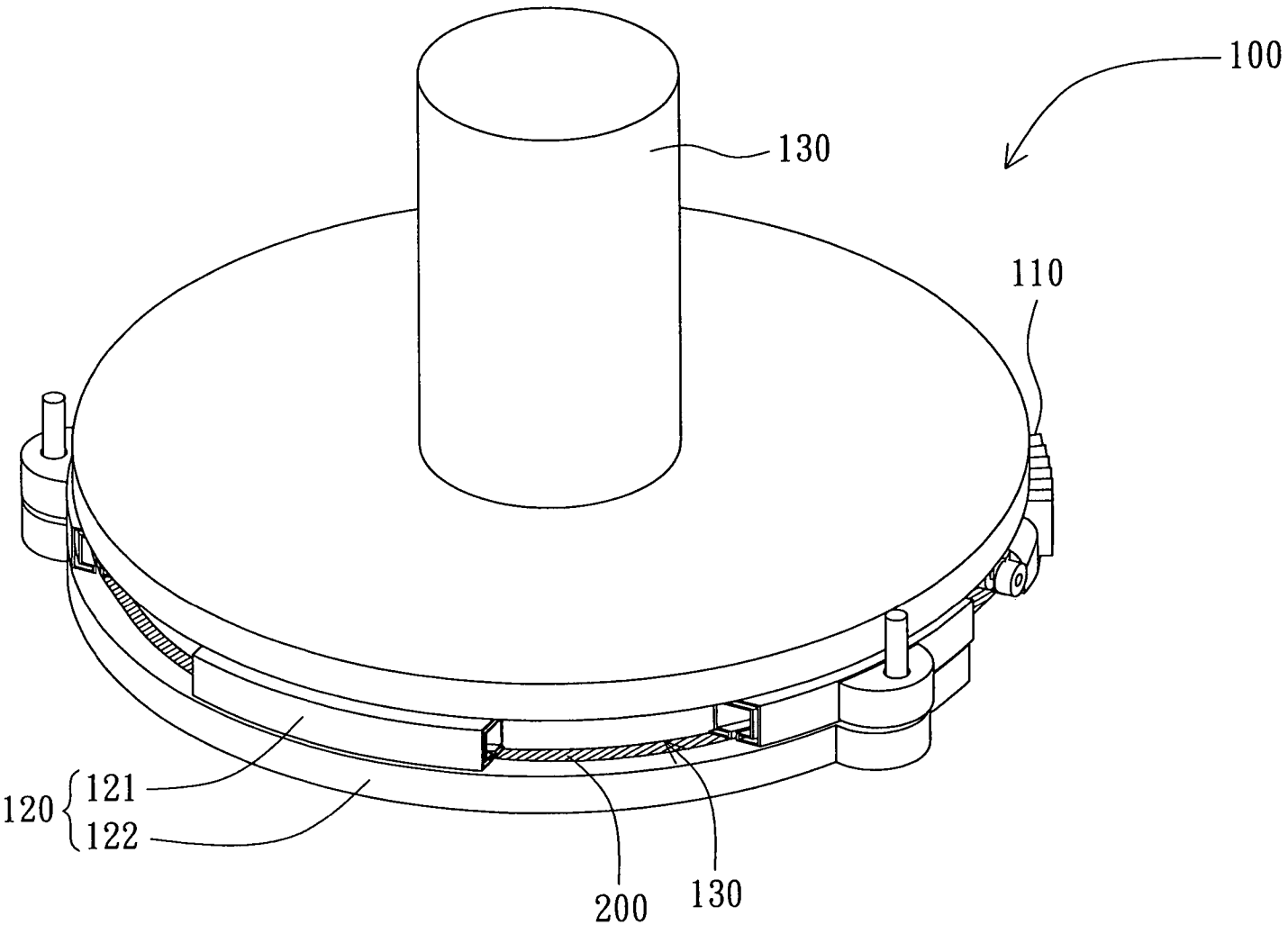
FIGS. 6A~6K illustrate steps in the pad replacing method in FIG. 5.

Please refer to FIG. 5. FIG. 5 is a flow chart of the pad replacing method of the present invention. For illustrating the pad replacing method of the present invention more clearly, please also refer to FIGS. 6A~6K which illustrate the steps of the pad replacing method. First, as shown in FIG. 6A, when the first clamping element 110 and the second clamping element 120 clamp the first polishing pad 200 and are connected with the periphery of the polishing head 130, the first polishing pad 200 flatly contacts the polishing surface 130*a*.

Figure 6B:
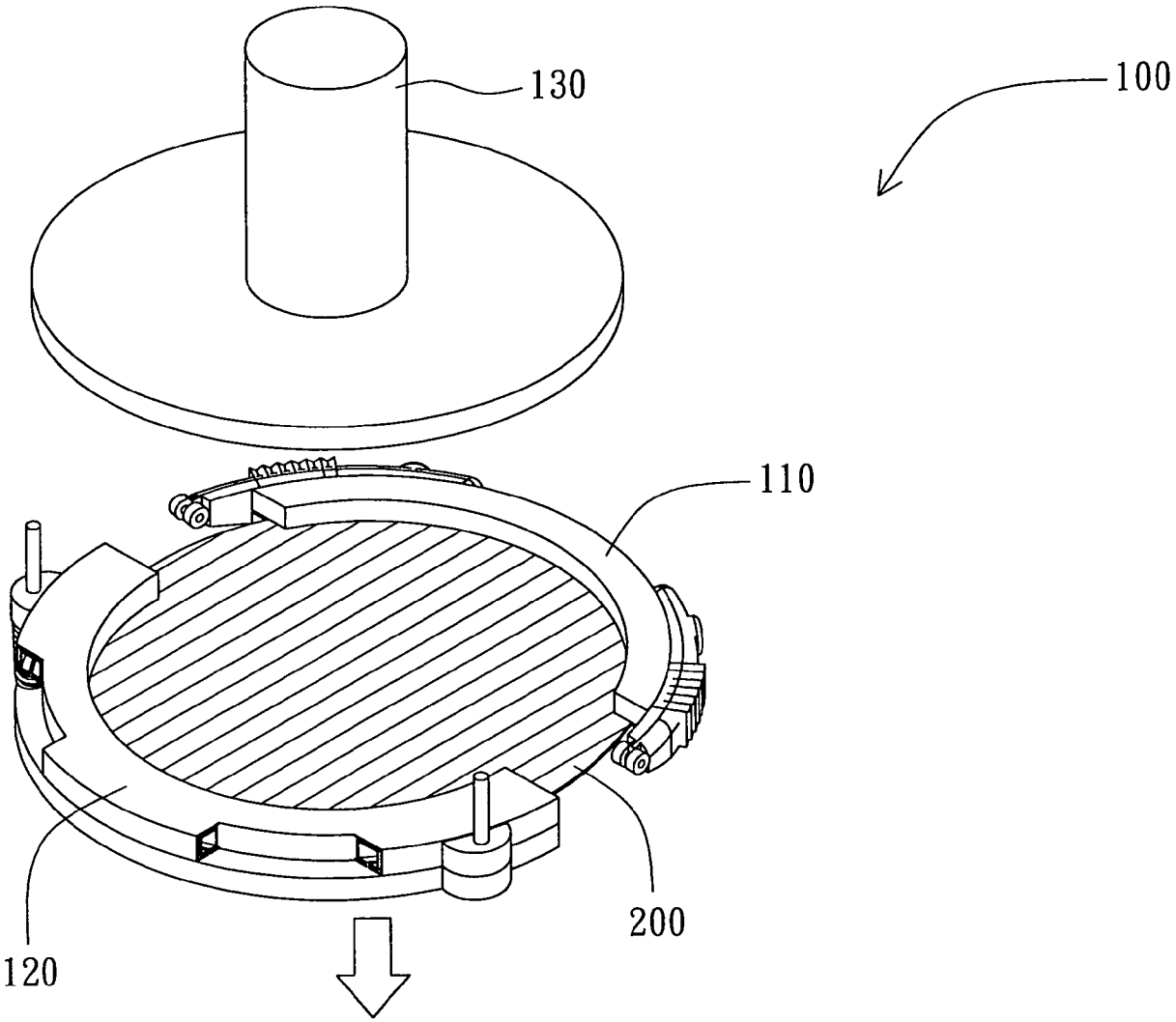

Next, in a step (a) in FIG. 5, the first clamping element 110 and the second clamping element 120 are driven to be unloaded from the polishing head 130, as shown in FIG. 6B.

Then, in a step (b) in FIG. 5, it is determined whether the first clamping element 110 and the second clamping element 120 clamp the first polishing pad 200. If yes, the method goes to a step (c). Otherwise, the method goes to a step (d).

Figure 6C:
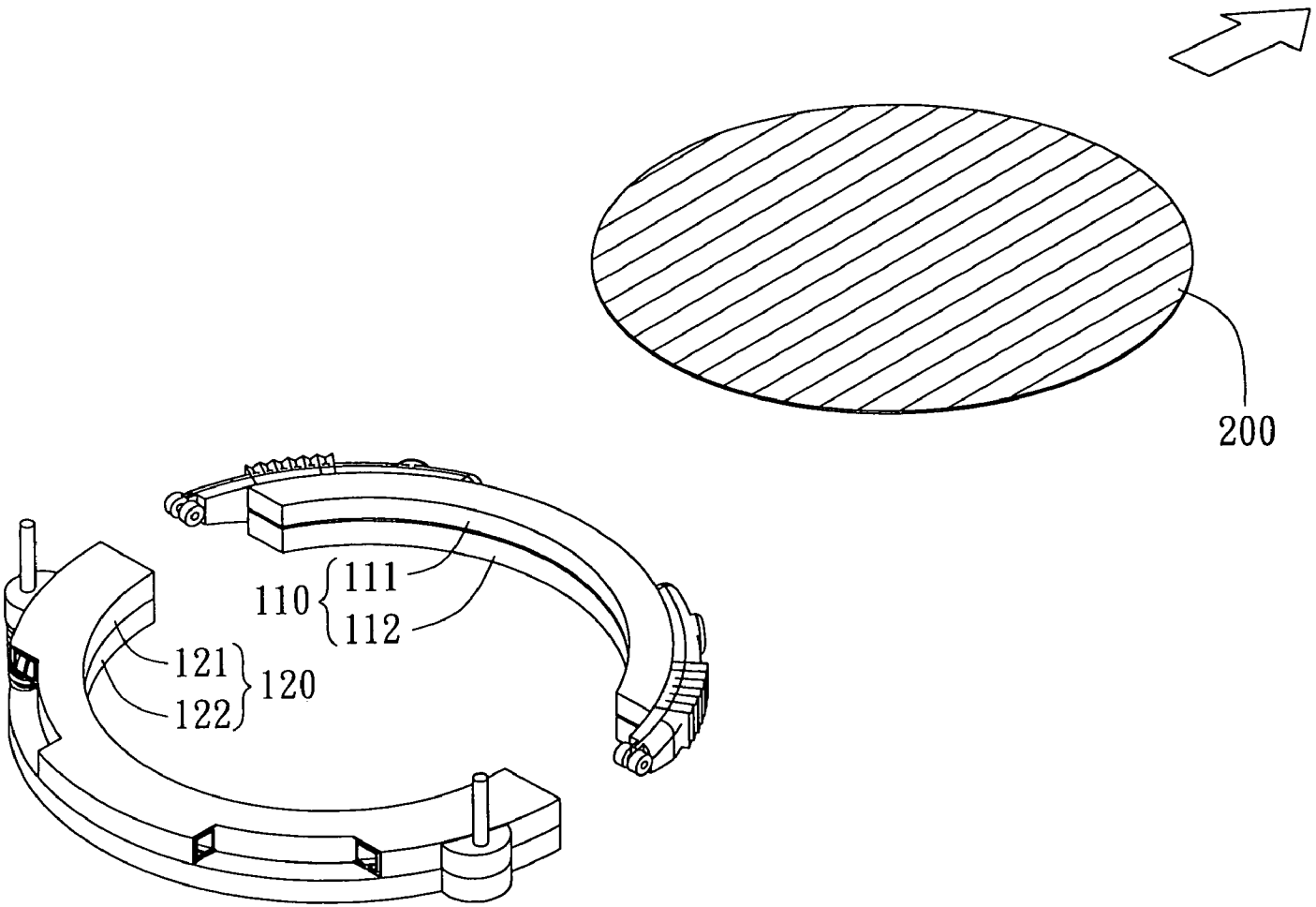

In the step (c) in FIG. 5, the first polishing pad 200 slides out from the first clamping element 110 and the second clamping element 120, as shown in FIG. 6C and FIG. 4. In the present embodiment, the first clamping element 110 drives the first rollers R110 to roll, so that the first polishing pad 200 slides out from the first upper clamper 111, the first lower clamper 112, the second upper clamper 121 and the second lower clamper 122. When the first polishing pad 200 slides, the second rollers R120 roll accordingly to help the first polishing pad 200 smoothly slide out from the second upper clamper 121 and the second lower clamper 122 (the first roller R110 and the second roller R120 illustrated in FIG. 4).

Figure 6D:
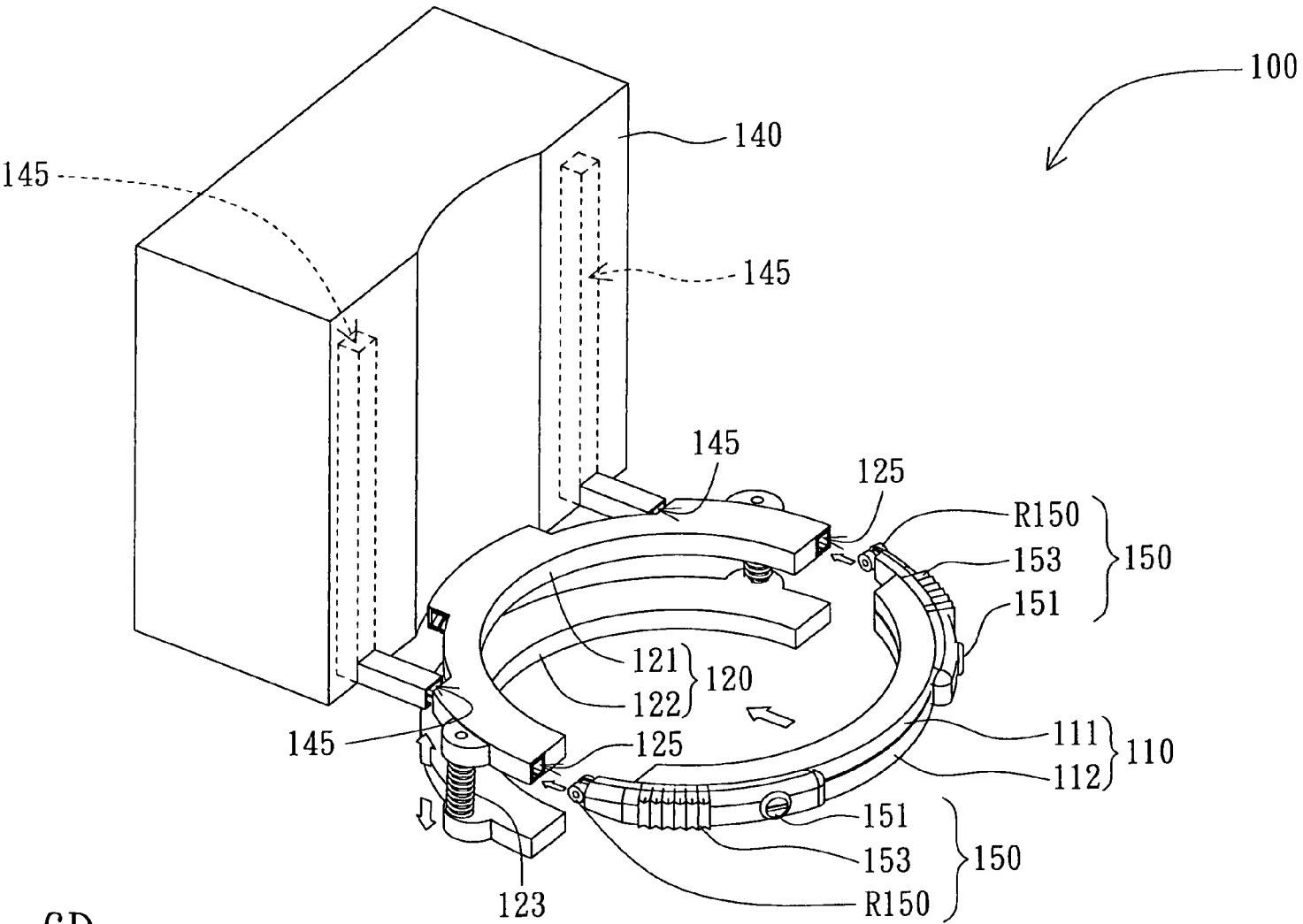
Figure 6E:
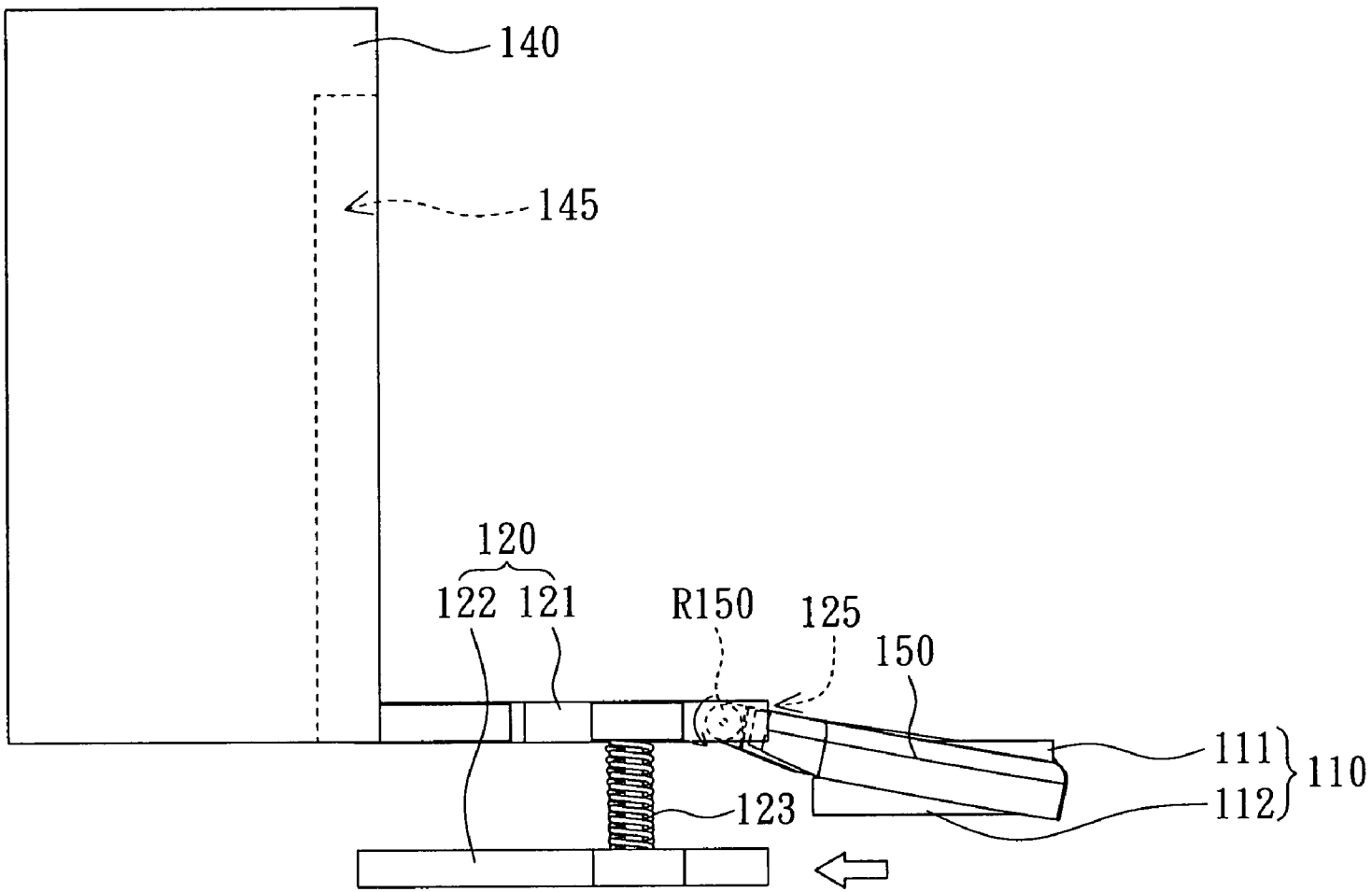
Figure 6F:
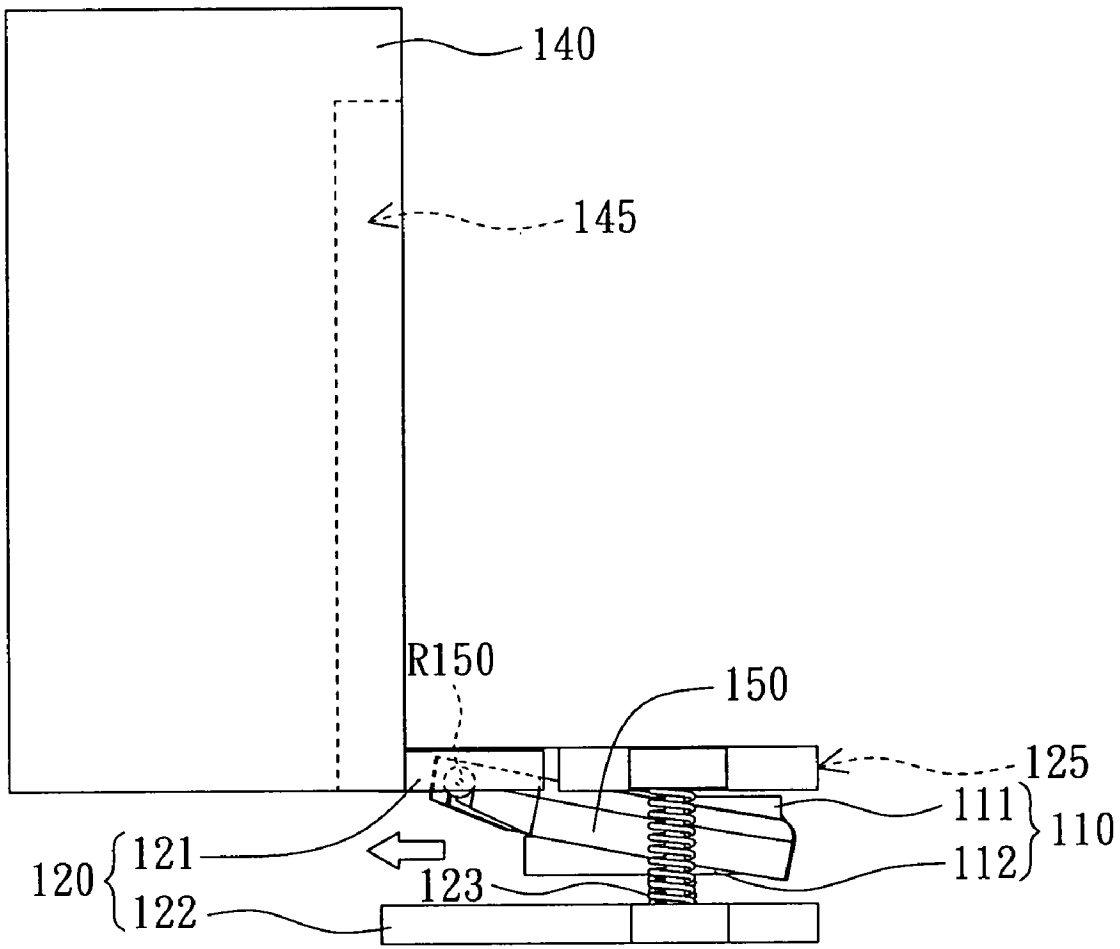
Figure 6G:
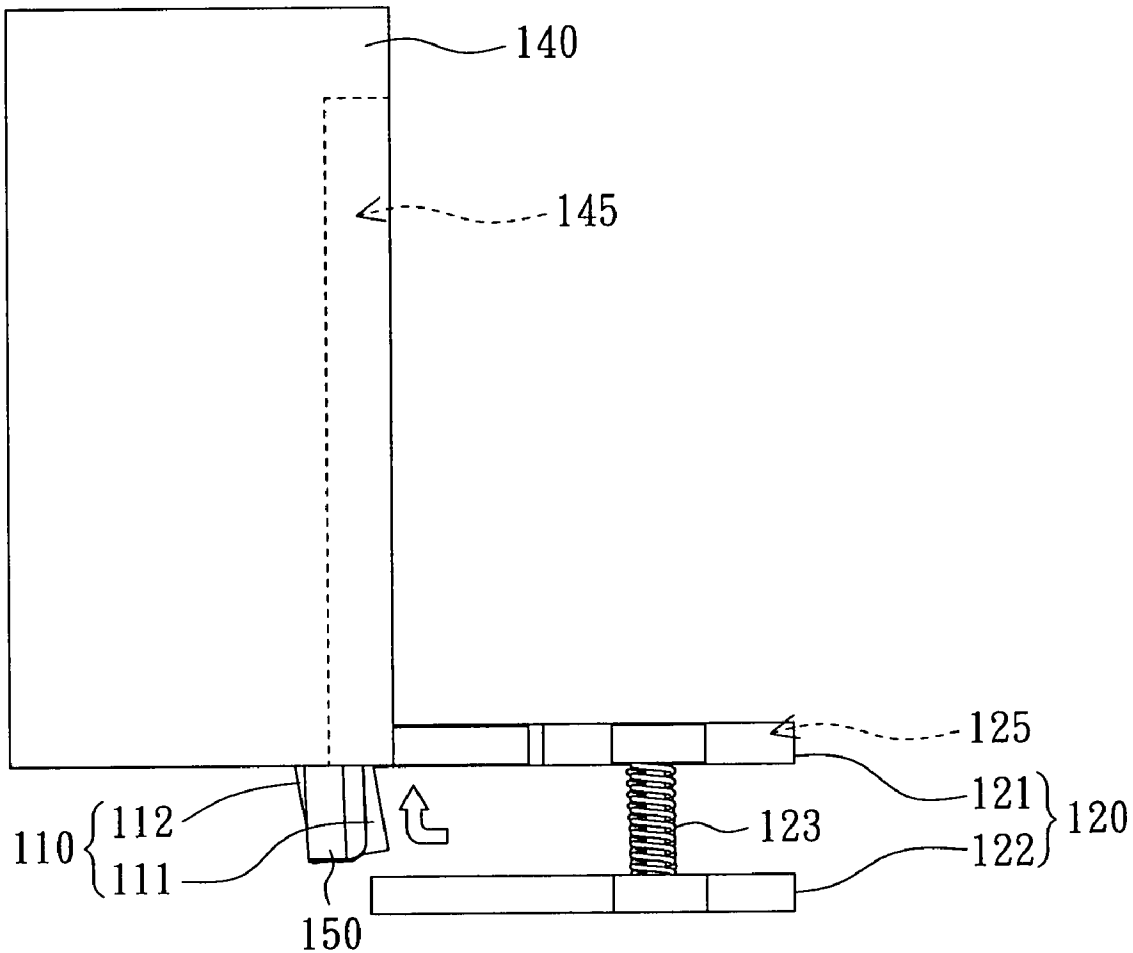
Figure 6H:
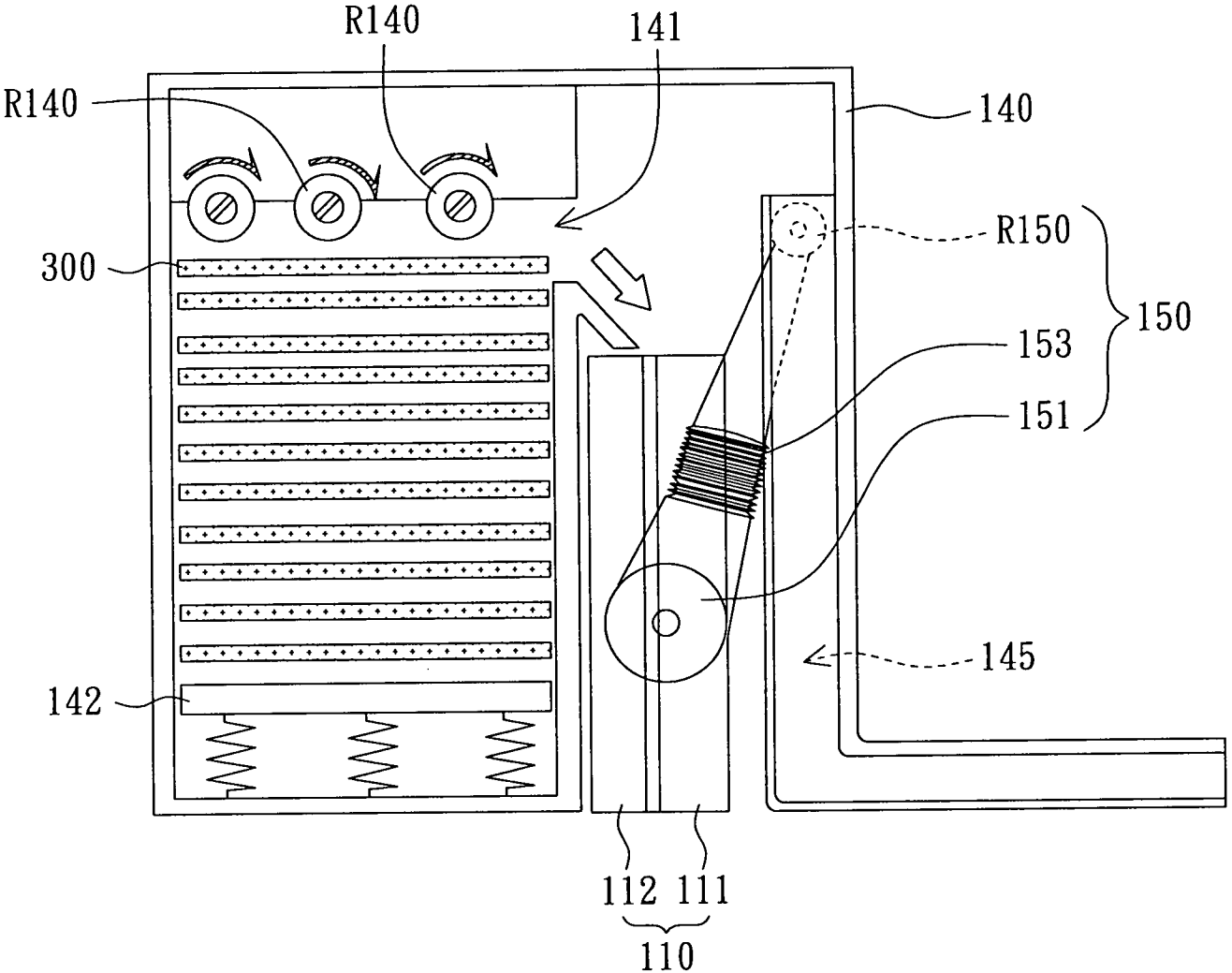

Afterward, in the step (d) in FIG. 5, the second polishing pad 300 are driven to slide into the first clamping element 110 and the second clamping element 120, as shown in FIGS. 6D~6G (the second polishing pad 300 illustrated in FIG. 6H). The step (d) further includes several sub-steps (d0) to (d4). Before the step (d) is described, the detail structures of the polishing apparatus 100 are illustrated first in order to describe following steps more clearly.

Please refer to FIG. 6D. The polishing apparatus 100 further includes a pad-replacing box 140 for providing the second polishing pad 200. The second polishing pad 200 is stored in the pad-replacing box 140. The pad-replacing box 140 includes box tracks 145 extending from the outside to the inside of the bottom of the pad-replacing box 140. The second upper clamper 121 includes two clamper tracks 125. Each box track 145 is connected with one clamper track 125 for forming an L-shaped tunnel.

The polishing apparatus 100 further includes two arms 150. Each arm 150 includes a pivot 151, a third roller R150 and a flexible structure 153. The pivot 151 is disposed at one end of the arm 150. The arm 150 is connected with the first clamping element 110 through the pivot 151. As a result, the arm 140 can swing relative to the first clamping element 110 and around the pivot 151. The third roller R150 is disposed at the other end of the arm 150 and capable of moving along the clamper tracks 125 and the box tracks 145. The flexible structure 153 is disposed between the pivot 151 and the third roller R150 for providing the deformation of the arm 150 in the moving process.

Moreover, the second clamping element 120 further includes two elastic elements 123 coupled with the second upper clamper 121 and the second lower clamper 122. The elastic elements 123 are between the second upper clamper 121 and the second lower clamper 122. As a result, the second upper clamper 121 and the second lower camper 122 open and close elastically.

The step (d) includes several sub-steps (d0) to (d4) for driving the second polishing pad 300 to slide into the clamping element 110 and the second clamping element 120.

In the sub-step (do), the second upper clamper 121 and the second lower clamper 122 are opened, as shown in FIG. 6D. As a result, the first clamping element 110 passes through the second clamping element 120 and between the second upper clamper 121 and the second lower clamper 122, as shown in FIGS. 6D.

In the sub-step (d1), the third rollers R150 of the arms 150 are driven, so the arms 150 slide along the clamper tracks 125 and the box tracks 145, as shown in FIGS. 6E~6G. The first clamping element 110 is driven to pass through the second clamping element 120 and enter the pad-replacing box 140.

Please referring to FIG. 6H, the box 140 further includes a storage tank 141, a tray 142 and several fourth rollers R140. The storage tank 141 is for storing the second polishing pad 300. The tray 142 is disposed on the bottom of the storage tank 141 for carrying the second polishing pad 300. The fourth rollers R140 are disposed at the top of the storage tank 141. The bottom of the tray 142 is supported by several springs, so that the tray 142 pushes the second polishing pad 300 upward to contact the fourth rollers R140.

Afterward, in the sub-step (d2), the fourth rollers R140 are driven to roll for driving the second polishing pad 300 to slide between the first upper clamper 111 and the first lower clamper 112, as shown in FIG. 6H. When the second polishing pad 300 slides between the first upper clamper 111 and the second lower clamper 112, the second polishing pad 300 slides to the end of the first clamping element 110 through the first rollers R110 of the first clamping element 110.

Figure 6I:
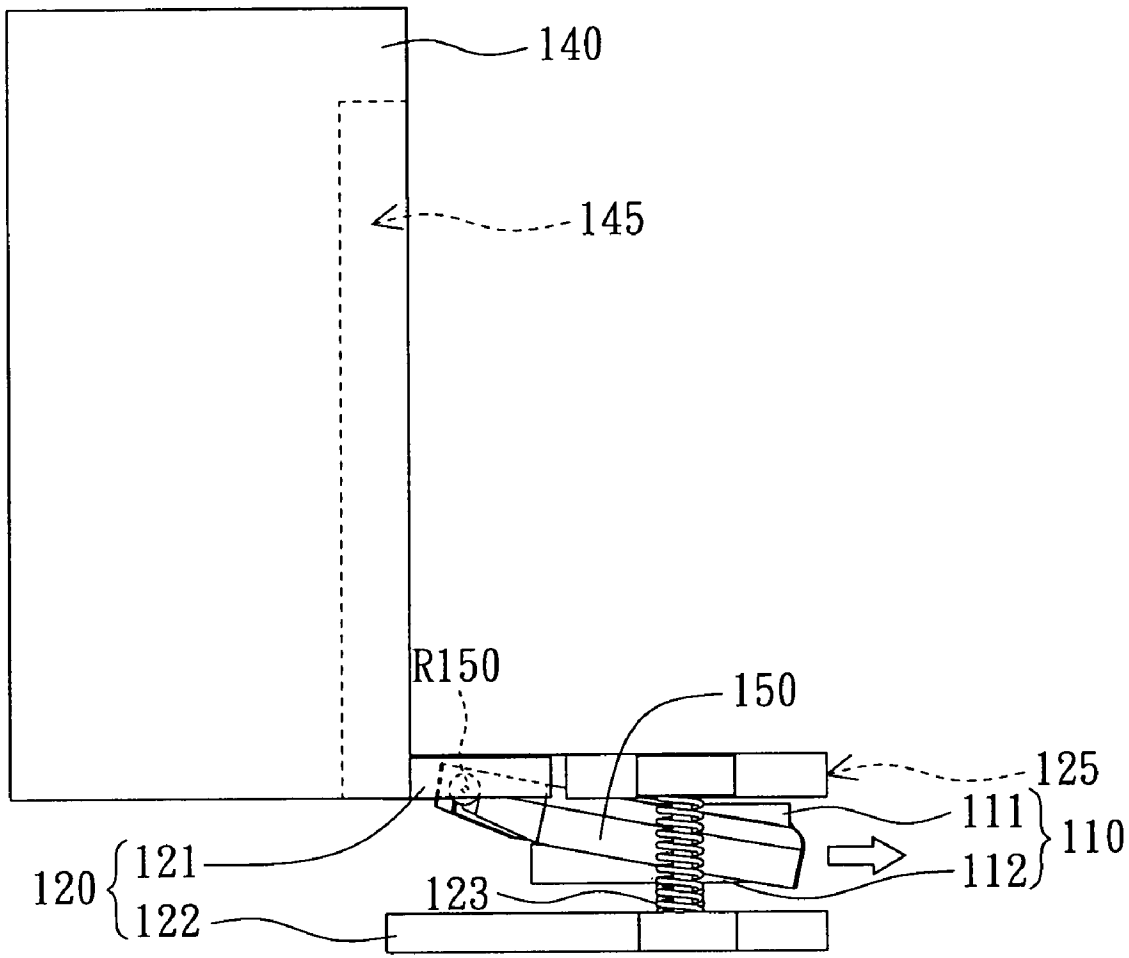

Subsequently, in the sub-step (d3), the third rollers R150 of the arms 150 are driven to roller along an opposite direction, so that the arms 150 slide along the box track 145 and the clamper track 125, as shown in FIG. 6I. The first clamping element 110 passes through the second clamping element 120 and moves out from the box 140. The motion in the sub-step (d3) is opposite the motion in the sub-step (d1).

Figure 6J:
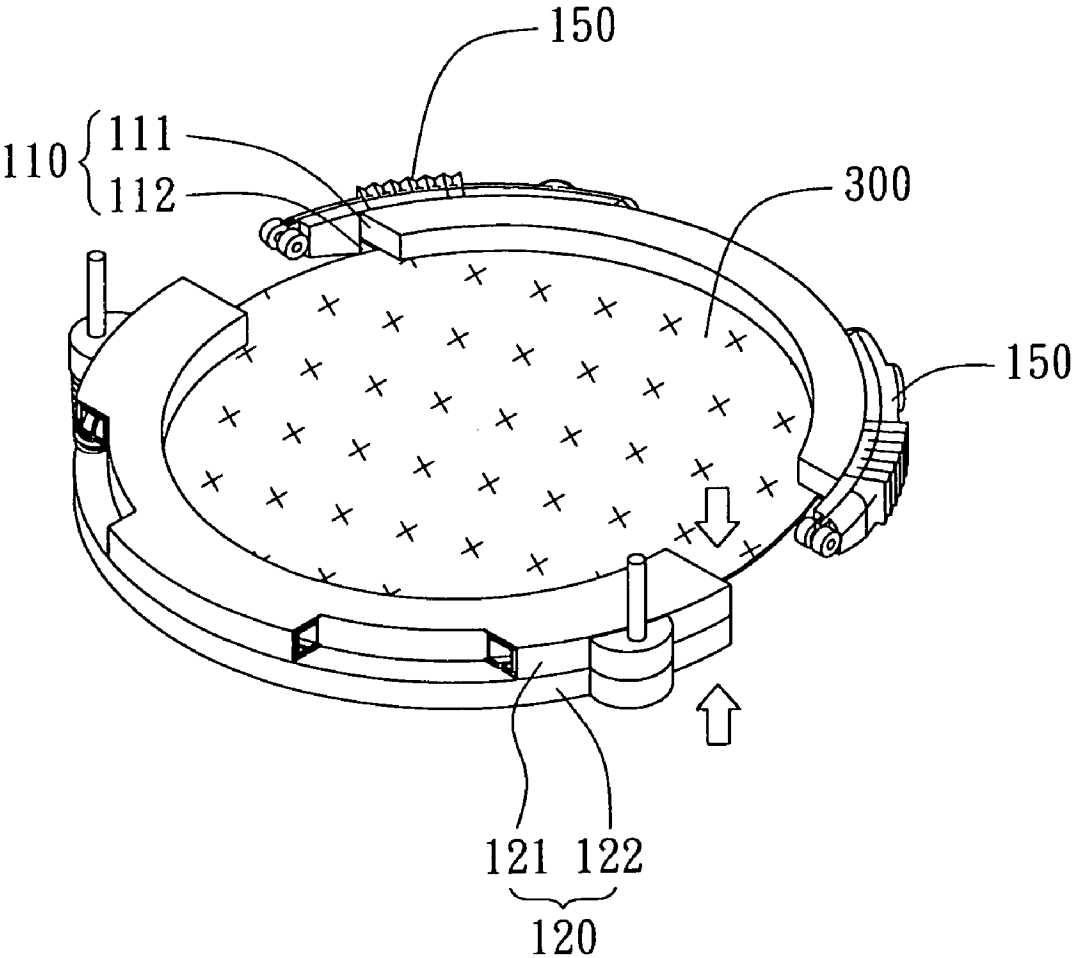

Later, in the sub-step (d4), the second upper clamper 121 and the second lower clamper 122 are closed for clamping the second polishing pad 300, as shown in FIG. 6J. The step (d) is completed in this sub-step.

Figure 6K:
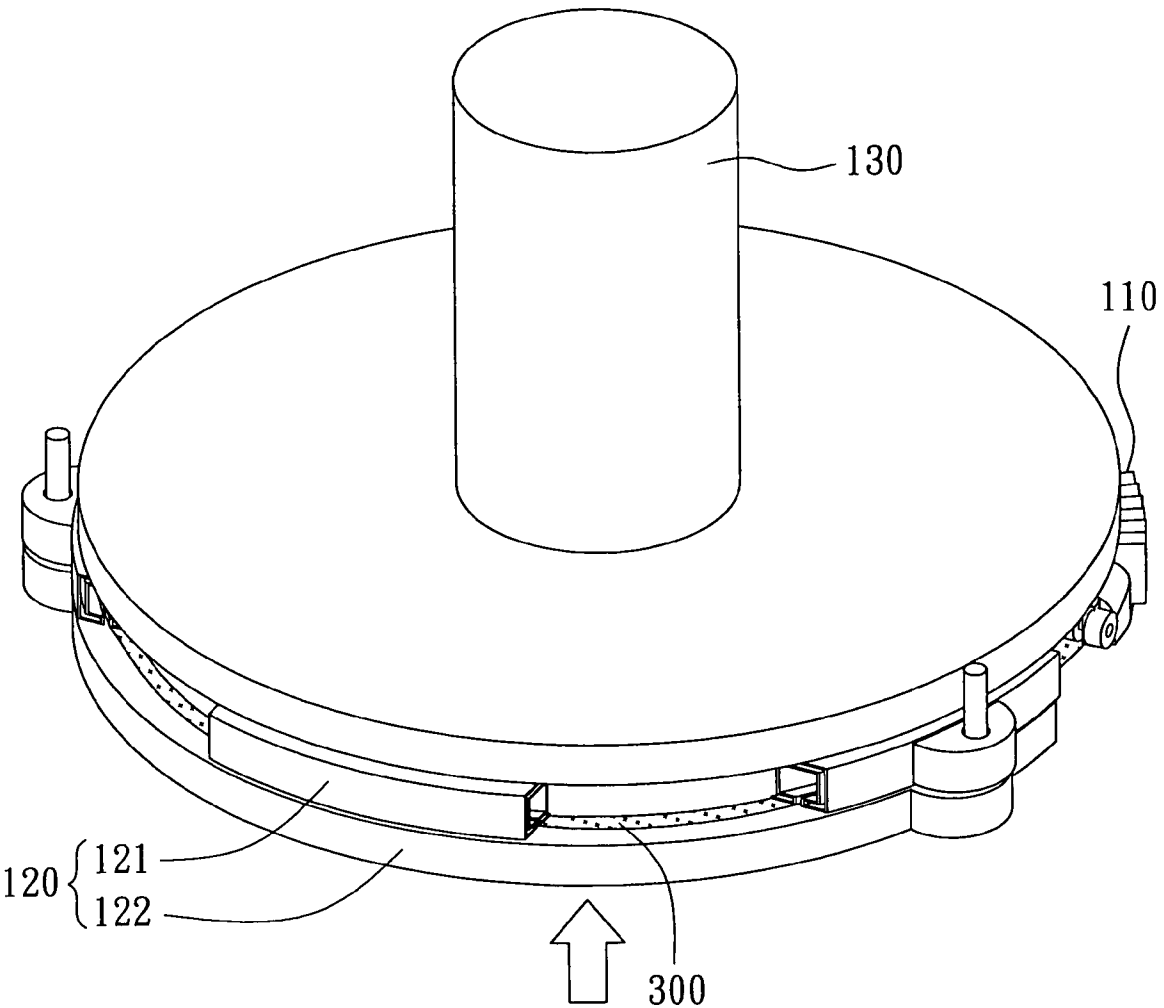

Thereon, in a step (e) in FIG. 5, the first clamping element 110 and the second clamping element 120 are connected with the periphery of the polishing head 130, as shown in FIG. 6K.

Figure 7:
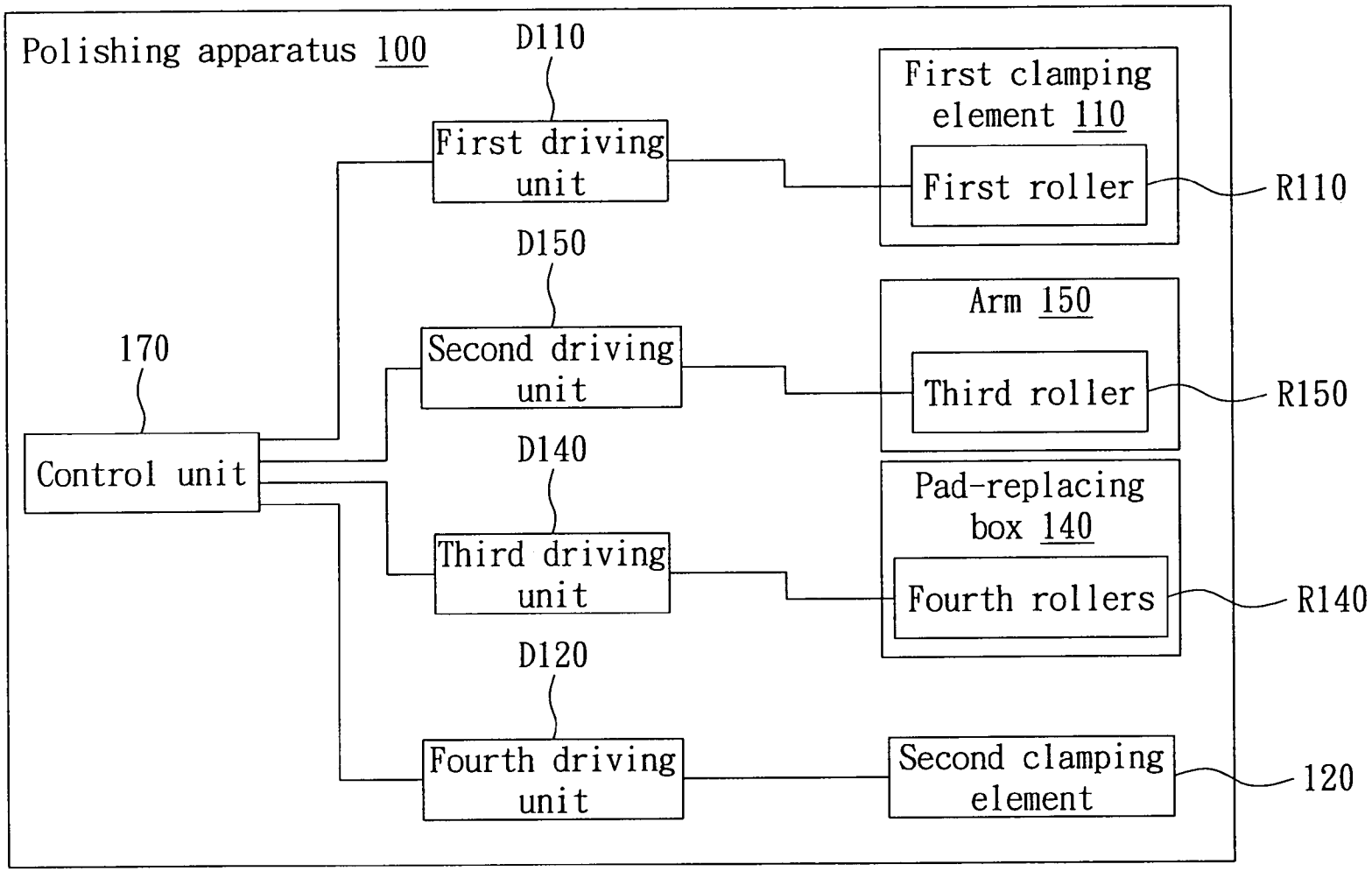
FIG. 7 is a function block diagram of the polishing apparatus in FIG. 3.

FIG. 7 is a function block diagram of the polishing apparatus 100 in FIG. 3. Please referring to FIG. 7, the polishing apparatus 100 further includes a first driving unit D110, a second driving unit D150, a third driving unit D140, a fourth driving unit D120 and a control unit 170. The control unit 170 is electrically connected with the first driving unit D110, the second driving unit D150, the third driving unit D140 and the fourth driving unit D120. The first driving unit D110, the second driving unit D150, the third driving unit D140 and the fourth driving unit D120 are driving motors for example. The first driving unit D110 is for driving the first rollers R110. The second driving unit D150 is for driving the third rollers R150. The third driving unit D140 is for driving the fourth rollers R140. The fourth driving unit D120 is for driving the second upper clamper 121 and the second lower clamper 122 to open or close.

In the above-described pad-replacing method, the control unit 170 controls the first driving unit D110, the second driving unit D150, the third driving unit D140 and the fourth driving unit D120 for replacing the polishing pad automatically. There is no need to use tools to replace the polishing pad, so it is very convenient.

In the polishing apparatus and the pad replacing method thereof in the above embodiment, the first clamping element and the second clamping element are used for clamping the polishing pad. Also, the pad-replacing box is used so the polishing apparatus and the pad replacing method thereof are very convenient to use and perform respectively. The advantages are as follow.

First, the pad replacing time is reduced. In the pad removing process of the polishing apparatus of the present invention, there is no need to use tools to remove the polishing pad. The polishing pad slides out from the first clamping element and the second clamping element for unloading the polishing pad. A new polishing pad slides into the first clamping element and the second clamping element for replacing the old polishing pad. Furthermore, through the pad-replacing box, the first driving unit, the second driving unit, the third driving unit and the fourth driving unit, the polishing pad is replaced automatically. The time for replacing the polishing pad is reduced.

Second, the yield rate of the apparatus is increased. Through the design of the present invention, the polishing pad is replaced in a short time. Therefore, the apparatus does not stop working very long. The yield rate of the apparatus is increased accordingly.

Third, the utilization efficiency of the polishing pad is increased. Through the polishing apparatus and the pad replacing method thereof, when the polishing pad needs to be replaced in some situations (such as removing conditions or manufacturing conditions being changed), the unloaded polishing pad is still complete and can be used again. Therefore, the utilization efficiency of the polishing pad is increased, and the manufacturing cost is lowered.

Fourth, the polishing head is prevented from damage. When the polishing pad is replaced, there is no need to use a tool to replace the polishing pad. Therefore, the polishing head is prevented from being damaged by the tool.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A polishing apparatus comprising:

a polishing head for releasably holding a first polishing pad that is clamped by a clamping device having first and second clamping elements;

the first clamping element, comprising;

a first upper clamper; and a first lower clamper, the first upper clamper and the first lower clamper for clamping a first area of a first polishing pad; and the second clamping element, comprising:

a second upper clamper; and a second lower clamper, the second upper clamper and the second lower clamper for clamping a second area of the first polishing pad, the first area and the second area opposite to each other; and wherein during polishing the first polishing pad is attached flatly with the bottom surface of the polishing head for polishing an article, the first clamping element and the second clamping element clamp the first polishing pad and are fastened on the periphery of the polishing head;

wherein when the first polishing pad needs replacing, the first clamping element and the second clamping element are released from the polishing head such that the first polishing pad will be disconnected from the bottom surface of the polishing head and replaced by a second polishing pad.

2. The polishing apparatus according to claim 1, wherein there is a first gap between the first upper clamper and the first lower clamper, there is a second gap between the second upper clamper and the second lower clamper, and the first clamping element further comprises:

a set of first rollers disposed on the first upper clamper or the first lower clamper and used to contact the first polishing pad or the second polishing pad, wherein the first polishing pad and the second polishing pad are moved into the first gap and the second gap by rotating the first rollers.

3. The polishing apparatus according to claim 2, further comprising:

a first driving unit for driving the first rollers.

4. The polishing apparatus according to claim 1, wherein the second clamping element further comprises:

a set of second rollers disposed on the second upper clamper or the second lower clamper and used to contact the first polishing pad or the second polishing pad, wherein the first polishing pad and the second polishing pad are moved into the first gap and the second gap by rotating the second rollers.

5. The polishing apparatus according to claim 1, wherein the second upper clamper comprises two clamper tracks, and the polishing apparatus further comprises:

a pad-replacing box for providing the second polishing pad, the pad-replacing box comprising two box tracks, each box track connected with one clamper track; and two arms, wherein each arm has a first end and a second end, the first end of each arm is connected and pivoted with the first clamping element, and the second ends of the arms are slid along the clamper tracks and the box tracks for driving the first clamping element passing through the second clamping element and moving into or out from the pad-replacing box.

6. The polishing apparatus according to claim 5, wherein each arm comprises:

a pivot disposed at the first end of the arm, the arm pivoted with the first clamping element by rotating the pivot; and a third roller located at the second end of the arm, the arm sliding along the clamper track and the box track by rotating the third roller.

7. The polishing apparatus according to claim 6, further comprising:

a second driving unit for driving the third rollers.

8. The polishing apparatus according to claim 6, wherein each arm further comprises:

a flexible structure disposed between the pivot and the third roller for providing a deformation of the arm.

9. The polishing apparatus according to claim 5, wherein there is a second gap between the second upper clamper and the second lower clamper, and the second clamping element further comprises:

two elastic elements disposed in the second gap and coupled with the second upper clamper and the second lower clamper, so that the second upper clamper and the second lower clamper close and open elastically;

when the second upper clamper and the second lower clamper open, the first clamping element passes through the second clamping element by driving the second ends of the arms sliding along the clamper tracks.

10. The polishing apparatus according to claim 5, wherein there is a first gap between the first upper clamper and the first lower clamper, and the pad-replacing box further comprises:

a storage tank for storing the second polishing pad;

a tray disposed on the bottom of the storage tank for carrying the second polishing pad; and a set of fourth rollers disposed at the top of the storage tank and used for contacting the second polishing pad stored in the storage tank, when the first clamping element moves into the pad-replacing box, the second polishing pad are moved into the first gap of the first clamping element by rotating the fourth rollers.

11. The polishing apparatus according to claim 10, further comprising:

a third driving unit for driving the fourth rollers.

* * * * *